US005571284A

United States Patent [19]

Kawamichi et al.

[11] Patent Number: 5,571,284

[45] Date of Patent: Nov. 5, 1996

[54] LINEAR MOTOR DRIVEN SHUTTLE MECHANISM FOR A PRINTER

[75] Inventors: Genichiro Kawamichi; Satoru Tobita; Shun Suzuki, all of Hitachinaka, Japan

[73] Assignee: Hitachi Koki Co., Ltd., Tokyo, Japan

[21] Appl. No.: 525,229

[22] Filed: Jun. 23, 1995

[30] Foreign Application Priority Data

Jun. 24, 1994 [JP] Japan ..... 6-143081

[51] Int. Cl.[6] ..... B41J 19/30

[52] U.S. Cl. ..... 400/322; 400/323; 310/12

[58] Field of Search ..... 400/320, 323, 400/322; 310/90, 12, 156

[56] References Cited

U.S. PATENT DOCUMENTS 494,213 9/1987 Gowda et al. ..... 310/90

4,318,038 3/1982 Munehiro ..... 400/322

4,837,472 6/1989 Kotera ..... 310/156

5,338,121 8/1994 Kobayashi et al. ..... 400/322

*Primary Examiner*—John S. Hilten

*Attorney, Agent, or Firm*—Whitham, Curtis, Whitham & McGinn

[57] ABSTRACT

To effectively cool a linear motor used in a shuttle mechanism of a printer and also to increase magnetic flux density used in generating thrust in the linear motor, each magnet used in the linear motor is beveled to form chamfers at corners that confront a coil member and that contact corners of adjacent magnets.

20 Claims, 3 Drawing Sheets

LINEAR MOTOR DRIVEN SHUTTLE MECHANISM FOR A PRINTER

BACKGROUND OF THE INVENTION

1. Field of the Invention

The present invention relates to a shuttle mechanism for bidirectionally moving a printing unit, and more particularly to a shuttle mechanism using a linear motor.

2. Description of the Related Art

There has been known a printer with dot print hammers for printing dot matrices on a printable medium. The dot matrices appear as characters, symbols, and the like on the printable medium. One such printer includes a shuttle mechanism using a linear motor. The shuttle mechanism drives a printing unit reciprocally and bidirectionally in a main scanning direction while the dot print hammers mounted on the printing unit are actuated.

The basic principles by which linear motors operate will be described while referring to FIGS. 1A and 1B. As shown in FIGS. 1A and 1B, a linear motor includes parallel upper and lower magnet banks 110*a* and 110*b* disposed in opposition with each other and separated by a minute space. Each of magnet banks 110*a* and 110*b* includes magnets 110' juxtaposed with alternate polarity, that is, if the inner face of one magnet 110' in a magnet bank 110*a* or 110*b* constitutes a south pole, then the inner face of the adjacent magnet in that bank constitutes a north pole, and so on. Each magnet 110' of each magnet bank, for example, in magnet bank 110*a*, has a corresponding magnet in the other magnet bank, for example, in magnet bank 110*b*. Corresponding magnets 110' are located directly opposite each other, and their facing pole faces are of opposite polarity, i.e., so that the south pole of one magnet 110' faces directly opposite the north pole of its corresponding magnet 110', and so on all along the magnet banks 110*a* and 110*b*.

A coil member 20 is disposed in the minute space between the upper magnet bank 110*a* and the lower magnet bank 110*b*. The coil member 20 has a plurality of conductors aligned parallel with alignment of the magnets 110'. Conductors of the coil member 20 are applied with current that flows perpendicular to the direction of the magnetic lines of force of the magnets in the magnet banks 110*a* and 110*b*. However, each conductor is applied with a current flowing in the opposite direction of current applied to adjacent conductors.

With the configuration shown in FIG. 1A, thrust is generated and the coil member 20 moves in the direction of force indicated by the arrow 81 in accordance with Fleming's left-hand rule. The direction of force will reverse when the coil member 20 moves to the position indicated in FIG. 1B. The coil member 20 will be reciprocally driven between the position shown in FIG. 1A and the position shown in FIG. 1B.

The strength of thrust F is represented by the following equation:

$$F=ntBLI$$

wherein n is the number of effective conductors mounted on the coil member 20, t is the number of turns in each conductor, B is the magnetic flux density, L is the effective length of the conductor, and I is the current.

FIG. 2 shows configuration of a conventional linear motor driven shuttle mechanism that works based on the above-described theory. Two side plates 62 and 63 are provided for supporting upper and lower yokes 30*a* and 30*b* and a guide shaft 70 aligned parallel with the alignment of the magnets 110'. The upper and lower magnet banks 110*a* and 110*b* are fixed to the upper and lower yokes 30*a* and 30*b*, respectively, in confronting relation with each other with a space therebetween. Bushes 60 attached to a base plate 50 are slidably movable along the guide shaft 70. The base plate 50 is provided for integrally connecting the coil member 20 to the bushes 60 so that the coil member 20 is suspended between the upper and lower magnet banks 110*a* and 110*b*. This configuration allows the coil member 20 to reciprocally and linearly move in parallel with alignment of the magnets 110'. Although not shown in the drawings, a printing unit such as a dot print hammer bank is secured to the base plate 50.

In order to increase magnetic flux density of the above-described mechanism, the gaps between the upper and lower surfaces of the coil member 20 and respective magnet banks 110*a* and 110*b* and between the yokes 30*a* and 30*b* are formed as narrow as possible. For example, the gaps between the coil member 20 and magnet banks 110*a* and 110*b* are usually formed to about 0.7 mm. Such narrow gaps limit ventilation so that heat builds up around the coil member 20. Even provision of a blower or cooling fan could not provide air flow sufficient to effectively cool this area.

The size of the coil 20 restricts the level of improvement in the magnetic flux density obtainable by narrowing the gaps between the two magnet banks 110*a* and 110*b* and between the two yokes 30. The magnetic flux density could be improved by changing the thickness of the magnet banks 110*a* and 110*b* and/or the material used to make the magnet banks 110*a* and 110*b*. However, such changes could be costly.

SUMMARY OF THE INVENTION

It is an object of the present invention to provide a linear motor driven shuttle mechanism that can be effectively cooled without changing materials of the magnets or sizes of the magnets while improving the performance of the print drive mechanism by providing magnets showing increased effective magnetic flux density.

A shuttle mechanism of the present invention uses a linear motor for bidirectionally moving a printing unit. The linear motor includes a first magnet bank, a second magnet bank, and a coil member. The first magnet bank includes a plurality of magnets juxtaposed in a first direction with alternate polarity. The second magnet bank also includes a plurality of magnets juxtaposed in the first direction with alternate polarity. The magnets of the second magnet bank are disposed to confront respective ones of the magnets in the first magnet bank individually with a space between the first magnet bank and the second magnet bank. The magnets of a confronting pair are of opposite polarity. The coil member is disposed in the space between the first magnet bank and the second magnet bank. The coil member has a conductor extending in a second direction perpendicular to the first direction. A supporting member is secured to the coil member and supports the printing unit wherein the supporting member is movable in a third direction perpendicular to both the first and second directions.

To achieve the above and other objects, the magnets in the first magnet bank and the second magnet bank have at least one chamfered face that substantially confronts the coil member. Preferably, each of the magnets in the first magnet bank and in the second magnet bank has two chamfered faces. The chamfered face in each of the magnets in the first magnetic bank faces the chamfered face of a corresponding magnet in the second magnetic bank. Preferably, the chamfered face forms an angle of 45° with respect to a surface defined by the first direction and the second direction.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

Figure 1A:
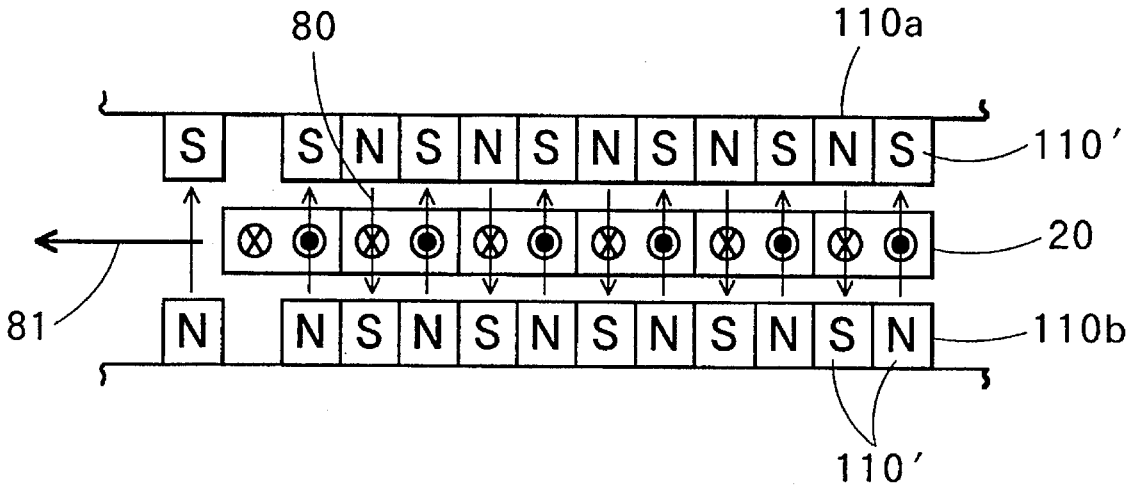
FIGS. 1A and 1B are explanatory diagrams illustrating a principle of a linear motor.
Figure 1B:
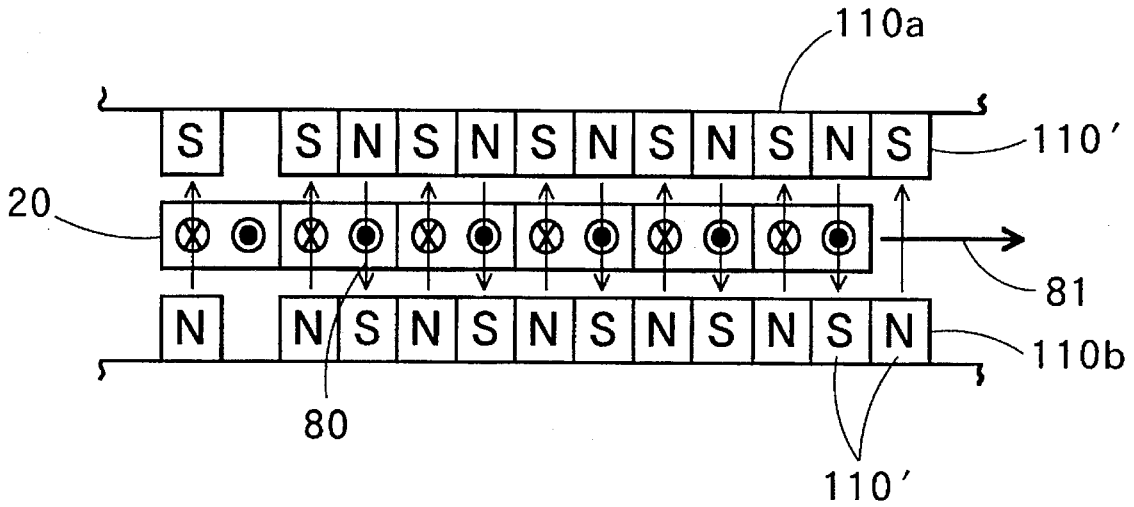
Figure 2:
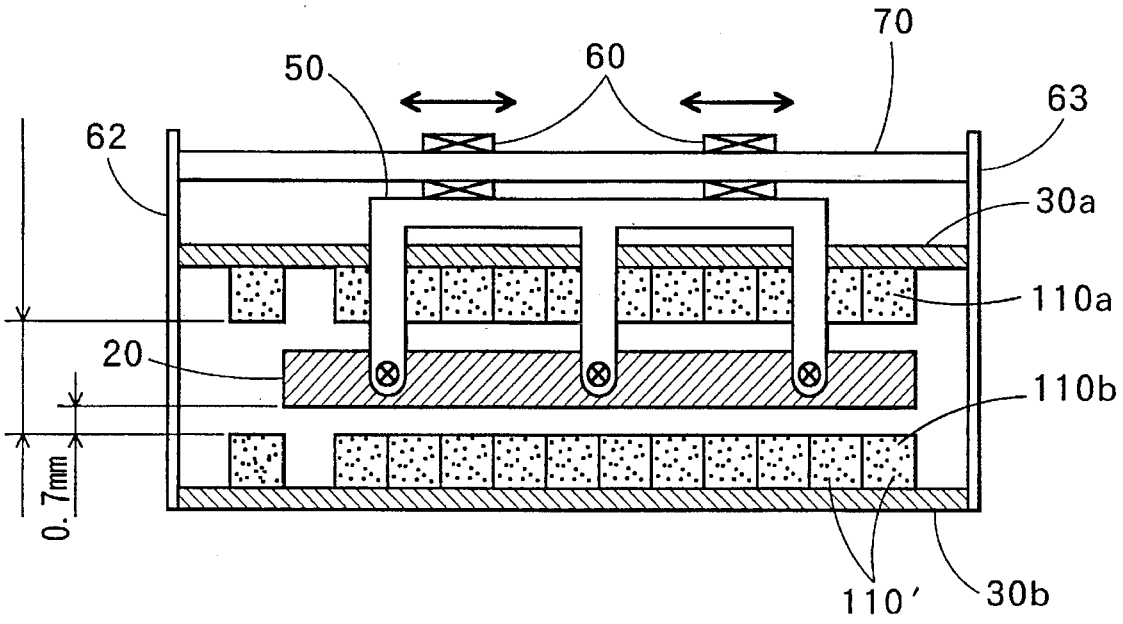
FIG. 2 is a cross-sectional view showing a conventional linear motor driven shuttle mechanism.

A print drive mechanism according to a preferred embodiment of the present invention will be described while referring to the accompanying drawings wherein the same parts and components are designated by the same reference numerals as in FIGS. 1 and 2 to avoid duplicating description.

Figure 3:
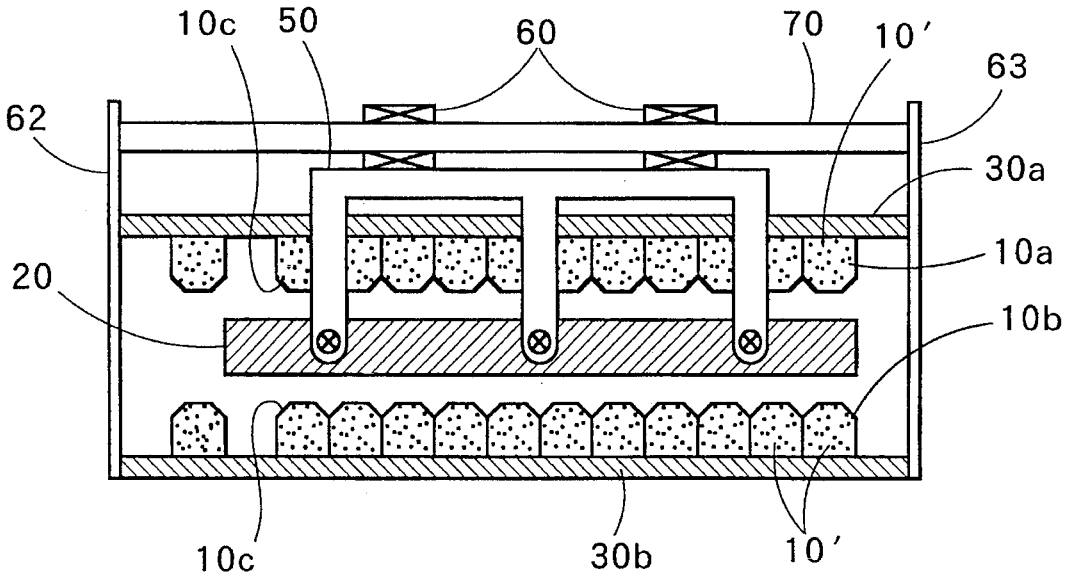
FIG. 3 is a cross-sectional view showing a linear motor driven shuttle mechanism according to a preferred embodiment of the present invention.

FIG. 3 schematically shows a shuttle mechanism according to the preferred embodiment. With the exception of the shape of magnets 10' in the magnet banks 10*a* and 10*b*, the shuttle mechanism of this embodiment has the same configuration as the conventional shuttle mechanism shown in FIG. 1.

A pair of magnet banks 10*a* and 10*b* are disposed in opposition. Each of magnet banks 10*a* and 10*b* includes magnets 10' juxtaposed with alternate polarity. That is, if the inner face of one magnet 10' in a magnet bank 10*a* or 10*b* constitutes a south pole, then the inner face of the adjacent magnet in that bank constitutes a north pole, and so on. Each magnet 10' of each magnet bank, for example, in magnet bank 10*a*, has a corresponding magnet in the other magnet bank, for example, in magnet bank 10*b*. Corresponding magnets 10' are located directly opposite each other, and their facing pole faces are of opposite polarity, i.e., so that the south pole of one magnet 10' faces directly opposite the north pole of its corresponding magnet, and so on all along the magnet banks 10*a* and 10*b*.

Current applied to the coil member 20 flows in a direction perpendicular to the lines of magnetic force of the magnet banks 10*a* and 10*b*. Therefore, the coil member 20 can be linearly and reciprocally propelled.

Each magnet 10' has been beveled at corners that confront the coil member 20 and that contact corners of adjacent magnets 10' to form chamfers 10C. The contacting corners, which have opposite polarity, have been removed. This secures space through which cooling air can flow, so that the area around the coil member 20 can be more effectively cooled. A cooling fan (not shown) is disposed to blow cooling air into the space between the upper and lower magnet banks 10*a* and 10*b* from a direction substantially parallel with a direction in which the current flows in the coil member 20.

Figure 4:
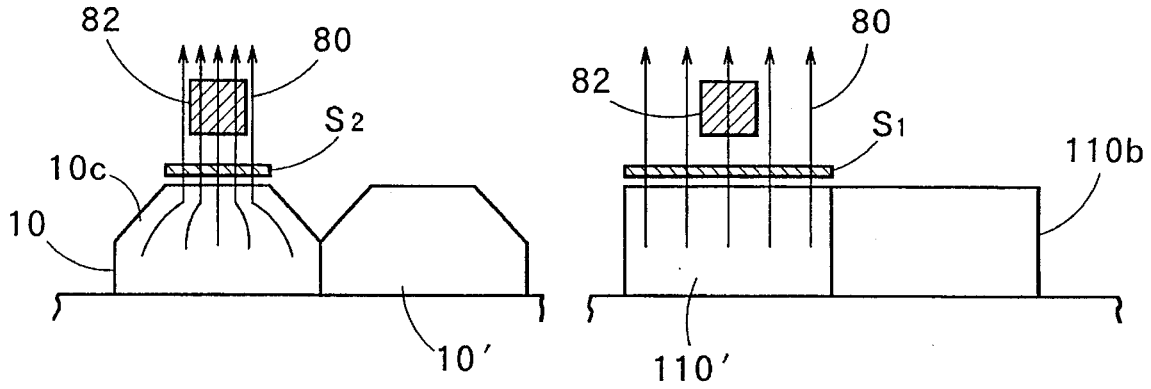
FIG. 4 is an explanatory diagram showing a difference in magnetic flux density between a magnet with chamfered faces and a magnet with no chamfered faces.

Magnetic flux of magnets 10' and of conventional magnets 110' is represented by arrows in FIG. 4. Assuming that magnets produce the same magnetic flux $\phi$ regardless of whether or not they are provided with chamfers 10C, the magnetic flux density B in an effective area 82 across which the coil member 20 traverses is inversely proportional to the surface area S through which the magnetic flux $\phi$ passes. The magnetic flux density in the area 82 is effectively used in inducing thrust in the coil member 20. This relationship can be represented by the following formula:

$$B=\phi/S.$$

In the example shown in FIG. 4, the magnetic flux of the magnet 10' passes through a surface area $S_2$, which is smaller than the surface area $S_1$ through which the magnetic flux of the magnet 110' passes. The magnetic flux density $B_1$ at the surface area $S_1$ when the corners of the magnet 110' are not chamfered is therefore less than the magnetic flux density $B_2$ at the surface area $S_2$ when the corners of the magnet 10' are chamfered, i.e., $B_1<B_2$. Therefore, beveling the corners of the magnets 10' to form the chamfers 10C increases magnetic flux density near the center of the magnet 10'.

The beveling method to produce the chamfers 10C will vary with the width of the magnet 10' and factors. For most circumstances, bevelling both edges 2.5 to 5.0 mm back from the corresponding corner would be sufficient. It is preferable to bevel the magnets to a 45° chamber angle.

Figure 5:
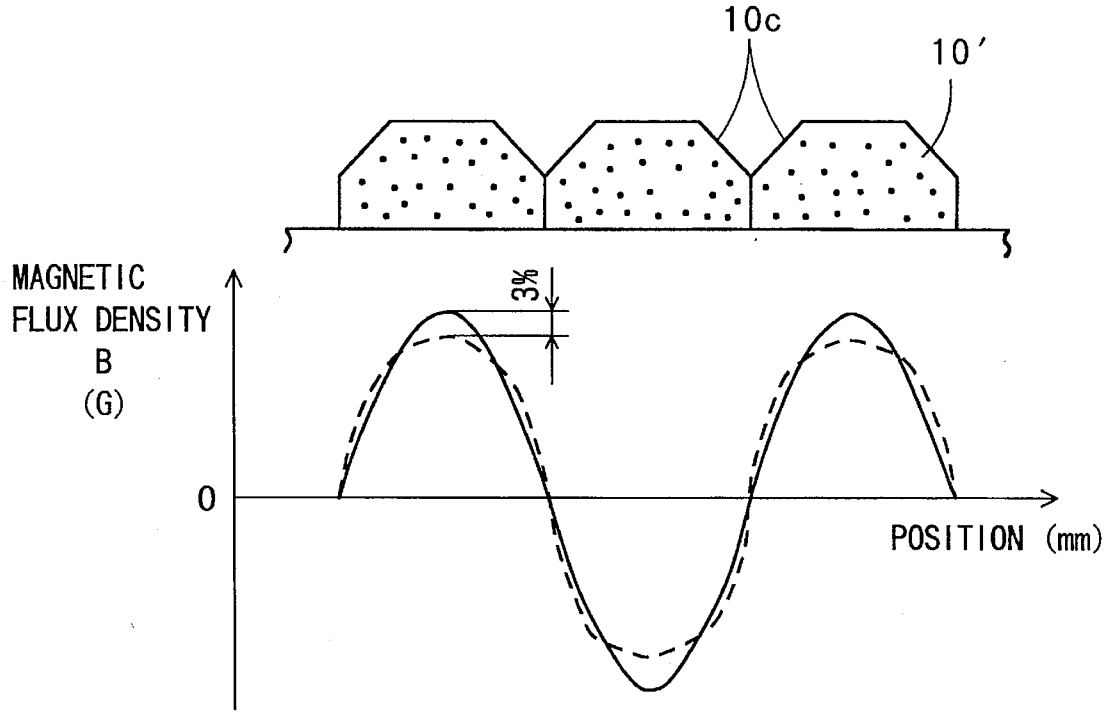
FIG. 5 is a graphical representation illustrating a difference in magnetic flux density between a magnet with chambered faces and a magnet with no chamfered faces.

FIG. 5 shows the distribution in magnetic flux density of magnets 10' used in the shuttle mechanism of the preferred embodiment and magnet 110' used in conventional shuttle mechanisms. As can be seen, the chamfers 10C give the magnets 10' a more desirable distribution of magnetic flux density and increase the magnetic flux density by 3% over conventional technology. In FIG. 5, the curve depicted by the solid line indicates the distribution in magnetic flux density produced by the chamfered magnets and the curve depicted by the dotted line indicates the distribution in magnetic flux density produced by the conventionally used magnets.

The chamfers 10C open pathways around the coil member 20 so that the coil member 10 can be effectively cooled by flow of air. Also, the effective magnetic flux density necessary for propelling the coil member 20 is increased. These two features improve the performance of this type of linear motor driven shuttle mechanism without changing the material or size of the magnet. Improvements in effective magnetic flux density reduce power consumption and heat generation of this type of linear motor. Therefore, the coil wire and the magnets can be made from inexpensive materials with low heat tolerance. As a result, not only is the performance of linear motor driven shuttle mechanisms improved, but the costs of their production are reduced.

While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. A shuttle mechanism for bidirectionally moving a printing unit for printing characters and symbols, the shuttle mechanism comprising:

a linear motor comprising:

a first magnet bank including a plurality of first magnets juxtaposed in a first direction, wherein adjacent magnets of said first magnets have alternate polarity;

a second magnet bank including a plurality of second magnets juxtaposed in the first direction, wherein adjacent magnets of said second magnets have alternate polarity and said second magnets are positioned to confront respective ones of the first magnets to form a plurality of confronting pairs, wherein said first magnets and said second magnets of said confronting pairs have opposite polarity, wherein said first magnet bank and said second magnet bank are positioned so as to have a space therebetween; and a coil member positioned in the space between said first magnet bank and said second magnet bank, said coil member having a conductor extending in a second direction perpendicular to the first direction, wherein the first magnets and the second magnets each have at least one chamfered face that substantially confronts said coil member; and a supporting member connected to said coil member and supporting the printing unit, said supporting member being movable in a third direction perpendicular to both the first and second directions.

2. A shuttle mechanism according to claim 1, wherein said at least one chamfered face comprises a beveled edge.

3. A shuttle mechanism according to claim 2, wherein said beveled edge is positioned in a range of substantially 2.5 mm to 5.0 mm from an edge of said first magnets and said second magnets.

4. A shuttle mechanism according to claim 1, wherein said at least one chamfered face comprises a beveled edge.

5. A shuttle mechanism according to claim 4, wherein said beveled edge is positioned in a range of substantially 2.5 mm to 5.0 mm from an edge of said first magnets and said second magnets.

6. A shuttle mechanism according to claim 4, wherein said space provides an area for flowing air therethrough.

7. A shuttle mechanism according to claim 1, wherein the chamfered face forms an angle of 45° with respect to a surface defined by the first direction and the second direction.

8. A shuttle mechanism according to claim 7, wherein said space provides an area for flowing air therethrough.

9. A shuttle mechanism according to claim 1, wherein said space provides an area for flowing air therethrough.

10. A shuttle mechanism for bidirectionally moving a printing unit for printing characters and symbols, the shuttle mechanism comprising:

a linear motor comprising:

a first magnet bank including a plurality of first magnets juxtaposed in a first direction, wherein adjacent magnets of said first magnets have alternate polarity;

a second magnet bank including a plurality of second magnets juxtaposed in the first direction, wherein adjacent magnets of said second magnets have alternate polarity and said second magnets are positioned to confront respective ones of the first magnets to form a plurality of confronting pairs, wherein said first magnets and said second magnets of said confronting pairs have opposite polarity, wherein said first magnet bank and said second magnet bank are positioned so as to have a space therebetween; and a coil member positioned in the space between said first magnet bank and said second magnet bank, said coil member having a conductor extending in a second direction perpendicular to the first direction, wherein the first magnets and the second magnets each have at least one chamfered face that substantially confronts said coil member; and a supporting member secured to said coil member and supporting the printing unit, said supporting member being movable in a third direction perpendicular to both the first and second directions, wherein each of the magnets in said first magnet bank and in said second magnet bank has two chamfered faces.

11. A shuttle mechanism according to claim 10, wherein the chamfered face in each of the first magnets in said first magnet bank faces the chamfered face of a corresponding second magnet in said second magnet bank.

12. A shuttle mechanism according to claim 11, wherein the chamfered face forms an angle of 45° with respect to a surface defined by the first direction and the second direction.

13. A printer comprising:

a printing unit for printing characters and symbols; and a shuttle mechanism for bidirectionally moving said printing unit, said shuttle mechanism comprising:

a linear motor comprising:

a first magnet bank including a plurality of first magnets juxtaposed in a first direction, wherein adjacent magnets of said first magnets have alternate polarity;

a second magnet bank including a plurality of second magnets juxtaposed in the first direction, wherein adjacent magnets of said second magnets have alternate polarity and said second magnets are positioned to confront respective ones of the first magnets to form a plurality of confronting pairs, wherein said first magnets and said second magnets of said confronting pairs have opposite polarity, wherein said first magnet bank and said second magnet bank are positioned so as to have a space therebetween; and a coil member movably positioned in the space between said first magnet bank and said second magnet bank, said coil member having a conductor extending in a second direction perpendicular to the first direction, wherein the first magnets and the second magnets each have at least one chamfered face that substantially confronts said coil member; and a supporting member connected to said coil member and supporting said printing unit, said supporting member being movable in a third direction perpendicular to both the first and second directions.

14. A printer according to claim 13, wherein said printing unit includes a hammer bank and a plurality of printing hammers connected to said hammer bank.

15. A printer according to claim 13, wherein the chamfered face forms an angle of 45° with respect to a surface defined by the first direction and the second direction.

16. A shuttle mechanism according to claim 13, wherein said space provides an area for flowing air therethrough.

17. A printer according to claim 13, wherein said space provides an area for flowing air therethrough.

18. A printer comprising:

a printing unit for printing characters and symbols; and a shuttle mechanism for bidirectionally moving said printing unit, said shuttle mechanism comprising:

a linear motor comprising:

a first magnet bank including a plurality of first magnets juxtaposed in a first direction, wherein adjacent magnets of said first magnets have alternate polarity;

a second magnet bank including a plurality of second magnets juxtaposed in the first direction, wherein adjacent magnets of said second magnets have alternate polarity and said second magnets are positioned to confront respective ones of the first magnets to form a plurality of confronting pairs, wherein said first magnets and said second magnets of said confronting pairs have opposite polarity, wherein said first magnet bank and said second magnet bank are positioned so as to have a space therebetween; and a coil member positioned in the space between said first magnet bank and said second magnet bank, said coil member having a conductor extending in a second direction perpendicular to the first direction, wherein the first magnets and the second magnets each have at least one chamfered face that substantially confronts said coil member; and a supporting member connected to said coil member and supporting said printing unit, said supporting member being movable in a third direction perpendicular to both the first and second directions, wherein each of the first magnets in said first magnet bank and each of the second magnets in said second magnet bank has two chamfered faces.

19. A shuttle mechanism according to claim 18, wherein the chamfered face in each of the first magnets in said first magnet bank faces the chamfered face of a corresponding second magnet in said second magnet bank.

20. A printer according to claim 19, wherein the chamfered face forms an angle of 45° with respect to a surface defined by the first direction and the second direction.

* * * * *